US005809966A

United States Patent [19]

Streib

[11] Patent Number: 5,809,966

[45] Date of Patent: Sep. 22, 1998

[54] METHOD AND ARRANGEMENT FOR CONTROLLING A POSITIONING DEVICE OF AN INTERNAL COMBUSTION ENGINE

[75] Inventor: Martin Streib, Vaihingen, Germany

[73] Assignee: Robert Bosch GmbH, Stuttgart, Germany

[21] Appl. No.: 818,777

[22] Filed: Mar. 14, 1997

[30] Foreign Application Priority Data

Mar. 15, 1996 [DE] Germany ..... 196 10 210.3

[51] Int. Cl.[6] ..... F02D 7/00

[52] U.S. Cl. ..... 123/399

[58] Field of Search ..... 123/399, 400

[56] References Cited

U.S. PATENT DOCUMENTS 4,947,815 8/1990 Peter ..... 123/399

5,562,081 10/1996 Hitchcock ..... 123/399

5,606,950 3/1997 Fujiwara et al. ..... 123/399

FOREIGN PATENT DOCUMENTS 4426971 2/1996 Germany .

*Primary Examiner*—Thomas N. Moulis

*Attorney, Agent, or Firm*—Walter Ottesen

[57] ABSTRACT

The invention is directed to a method and an arrangement for controlling a positioning element of an internal combustion engine. In the method and arrangement, a positioning element is used which exhibits a so-called torque-reversal point. If the positioning device is in the region of the torque-reversal point, then the drive signal for the positioning device is changed in the sense of a current change which is as abrupt as possible.

11 Claims, 4 Drawing Sheets

METHOD AND ARRANGEMENT FOR CONTROLLING A POSITIONING DEVICE OF AN INTERNAL COMBUSTION ENGINE

BACKGROUND OF THE INVENTION

U.S. Pat. No. 4,947,815 discloses a positioning device for a throttle flap of an internal combustion engine wherein the positioning element is electrically adjusted via a positioning motor on the basis of the driver command derived from a pedal actuation of the driver. The positioning device is preferably utilized in the context of a positioning control.

The positioning device exhibits the peculiarity that a specific position is assumed because of counter-acting springs when the positioning motor is at zero current. This rest position or emergency-air position of the positioning device ensures that the throttle flap, which is coupled to the positioning device, does not close completely when the actuator of the positioning device is at zero current; instead, the engine can continue to operate at least in idle operation. It is a disadvantage here that, at this point, the torque acting on the positioning motor changes in a jump-like or abrupt manner because of the changing resulting spring torque and the sign of the torque also changes. The spring torque acts to open the throttle flap below the rest position and tends to close the throttle flap above this rest position as shown in FIG. 5. This characteristic of the positioning device presents a significant difficulty for the position control and leads to an unfavorable control performance and especially leads to extended positioning times.

SUMMARY OF THE INVENTION

In view of the above, it is an object of the invention to improve the control characteristic of a positioning control wherein a positioning device has a rest position characterized by torque change.

The method of the invention is for controlling a positioning device of an internal combustion engine. The method includes the steps of: providing an electric motor for actuating the positioning device with the positioning device applying a torque to the motor which changes sign over the positioning range; generating a drive signal for the motor in the context of a position control, whereby the drive signal controls the current through the motor; and, changing the drive signal to abruptly change the current through the motor in the region of the torque reversal.

German Patent publication 4,426,971 discloses such a positioning device which is activated in the context of a control by means of a step motor. For movements beyond the rest position, the step-counter position, which is used to form the drive signals, is corrected in the sense of a linearization of the movement of the positioning device.

With the invention, the performance of the control loop and especially the control path (positioning device) is linearized. Lengthening the positioning time with movements beyond the rest position of the positioning device is effectively prevented.

It is especially advantageous that the solution of the invention is not applied when the positioning device is to be adjusted in the direct vicinity of the rest position of the positioning device. In this way, unstable states are avoided.

It is especially advantageous that the generated change of the drive torque of the positioning motor approximately compensates the torque change arising because of the rest position.

It is especially advantageous that the precision of the solution of the invention is increased because of learning of the positioning value by the control apparatus. The positioning value is associated with the rest position of the positioning device.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
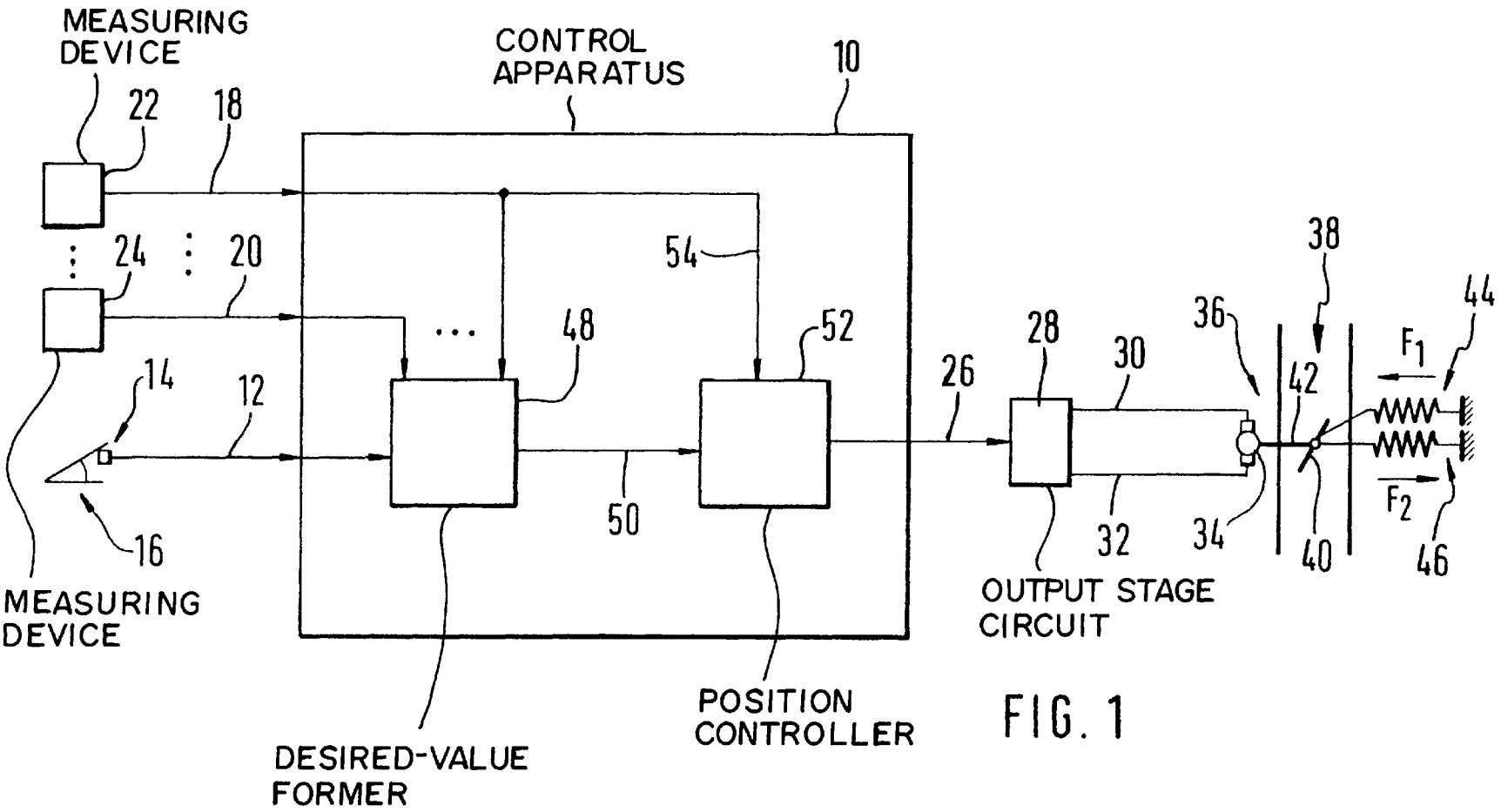
FIG. 1 is an overview block circuit diagram of a control arrangement for a positioning device of an internal combustion engine.

In FIG. 1, an electronic control apparatus 10 is shown. A measuring device 14 for detecting the position of an operator-controlled element 16, which is actuated by the driver, is connected to the apparatus 10 via an input line 12. Measuring devices 22 to 24 detect additional operating variables of the engine and/or of the vehicle and are connected to the control apparatus 10 via respective input lines 18 to 20. Operating variables of this kind are, for example, a variable for the air supply to the engine, the engine rpm, engine temperature, et cetera. An output line 26 of the control apparatus 10 is connected to an output stage 28, which is preferably a full bridge output stage. An electric motor 34 is connected to the output stage 28 via lines 30 and 32. The electric motor 34 is a motor of the positioning device 36 and is preferably a direct-current motor. The positioning device 36 functions to adjust a throttle flap 40 which is connected via a mechanical connection 42 to the motor 34. The throttle flap 40 is mounted in the intake system 38 of the engine. The positioning device 36 further includes at least two springs (44, 46), which generate mutually opposing forces (F1, F2) for adjusting the positioning device in a predetermined rest position.

Figure 5:
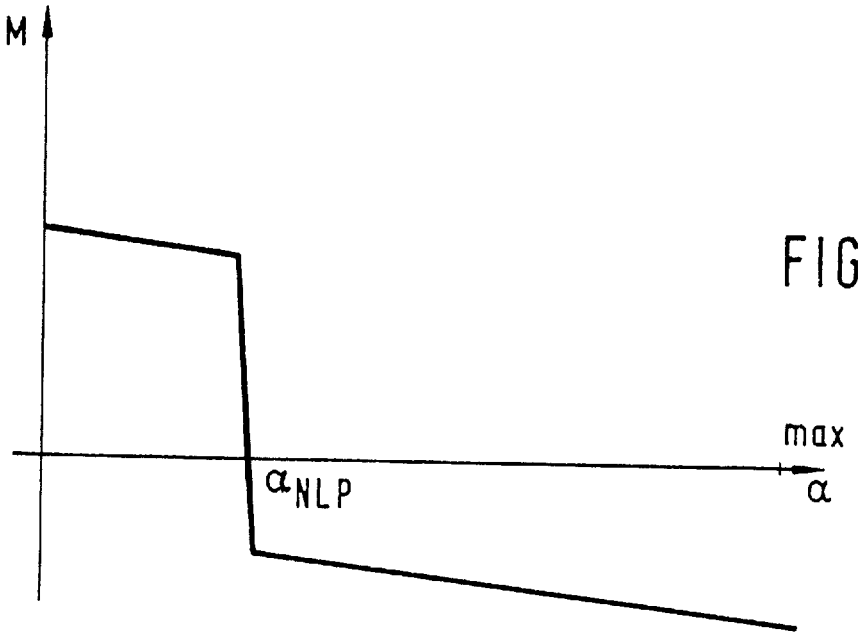

The positioning device 36 therefore exhibits a torque characteristic which is shown in FIG. 5. In FIG. 5, the torque M, which acts on the positioning motor 34, is plotted as a function of position $\alpha$ of the throttle flap. The positioning device can be adjusted from the position 0 (completely closed throttle flap) to a maximum position (completely open throttle flap).

In the positioning range from the position 0 to the rest position $\alpha$NLP, the spring 44 acts in a sense of opening the throttle flap. The opening torque applied to the motor is therefore positive in this region. The force of the spring 46 functions in a sense of a return positioning of the positioning element into the closed position of the throttle flap between the rest position $\alpha$NLP and the maximum position. For this reason, the torque, which is applied to the positioning element, is negative in this region.

In the preferred embodiment, the electronic control apparatus 10 includes at least one microcomputer in which program parts are installed. These program parts adjust the positioning device in dependence upon the command of the driver which is derived from the actuation of the operator-controlled element. For this purpose, a desired-value former 48 is provided to which the actuating signal of the operator-controlled element is supplied via the line 12 as well as selected operating variables via the lines 18 to 20. The output line 50 of the desired-value former 48 leads to a position controller 52 to which at least a line 54 and therefor a measure for the position of the positioning device 36 is supplied. Line 54 branches from at least one of the lines 18 to 20. The output line of the position controller 52 is the output line 26 of the control apparatus 10.

In the preferred embodiment, the measuring element 14 detects the degree of actuation of the operator-controlled element 16 (accelerator pedal). This is supplied to the desired-value former 48. Furthermore, operating variables from measuring devices 22 to 24 such as engine temperature, engine rpm, transmission position, exhaust-gas composition, air mass, et cetera, are supplied to the desired-value former 48. The desired-value former 48 forms a desired set value $\alpha_{des}$ for the positioning device 36 on the basis of predetermined characteristic lines, characteristic fields, tables or in the context of a torque control loop or a power control loop. The desired set value $\alpha_{des}$ is supplied via line 50 to the position controller 52. The position controller 52 forms the difference between the desired set value $\alpha_{des}$ and the actual position $\alpha_{act}$ of the positioning device 36. The actual position $\alpha_{act}$ is detected by a position transducer and is supplied via the line 54.

The position controller 52 then forms an output signal on the basis of the difference in accordance with the pregiven control strategy. The position controller 52 includes at least one integrating component, and, in a preferred embodiment, further includes a proportional component and a differential component. The controller 52 forms its output signal in a sense of an adjustment of the positioning device 36 to the pregiven desired value. The drive signal for the output stage circuit 28 is, in a preferred embodiment, a pulsewidth-modulated signal having a changing pulse-duty factor which represents the mean current flow through the electric motor 34 and therefore the drive torque of the positioning device. In other advantageous embodiments, the drive signal quantity can be a current value, a voltage value, a pulselength or the time interval between two pulses.

For movements of the positioning device 36, the position actual value is continuously controlled to improve the control performance in the region of the so-called torque-reversal point in the rest position of the positioning device 36. If the positioning device moves beyond the torque-reversal point, then the drive torque of the positioning motor or the motor current is changed in a quasi jump-like manner. A precise jump-shaped change is not possible because of the inductance of the electric motor. The amount of this jump-like change is so selected that the change of the drive torque occurring thereby approximately compensates the jump, which arises at the torque-reversal point, in the spring torque.

In the preferred embodiment, the current change is generated in that the integral component of the controller is changed by a defined pregiven amount or in that the pulse-duty factor, with which the output stage is driven, is changed in a jump-like manner. This amount is impressed once upon the integral component or on the drive signal quantity when there is a pass-through through the rest position and this amount is then not continuously maintained. If the desired set value for the positioning device is very close to the torque-reversal point, an unstable condition could occur because of the solution provided by the invention because of a continuous current change. This is effectively avoided in that the compensation according to the invention is only then applied when the desired set value does not lie in the direct vicinity of the torque-reversal point. The torque-reversal point (rest position) exhibits certain tolerances from one adjusting element to the other. For this reason, and to increase precision, the electronic control apparatus learns the position of the positioning element when the positioning device is at zero current.

The measures described above are carried out in the region of the position controller 52. A preferred embodiment of the realization of these measures as a computer program is shown in the flowcharts of FIGS. 2 and 3.

Figure 2:
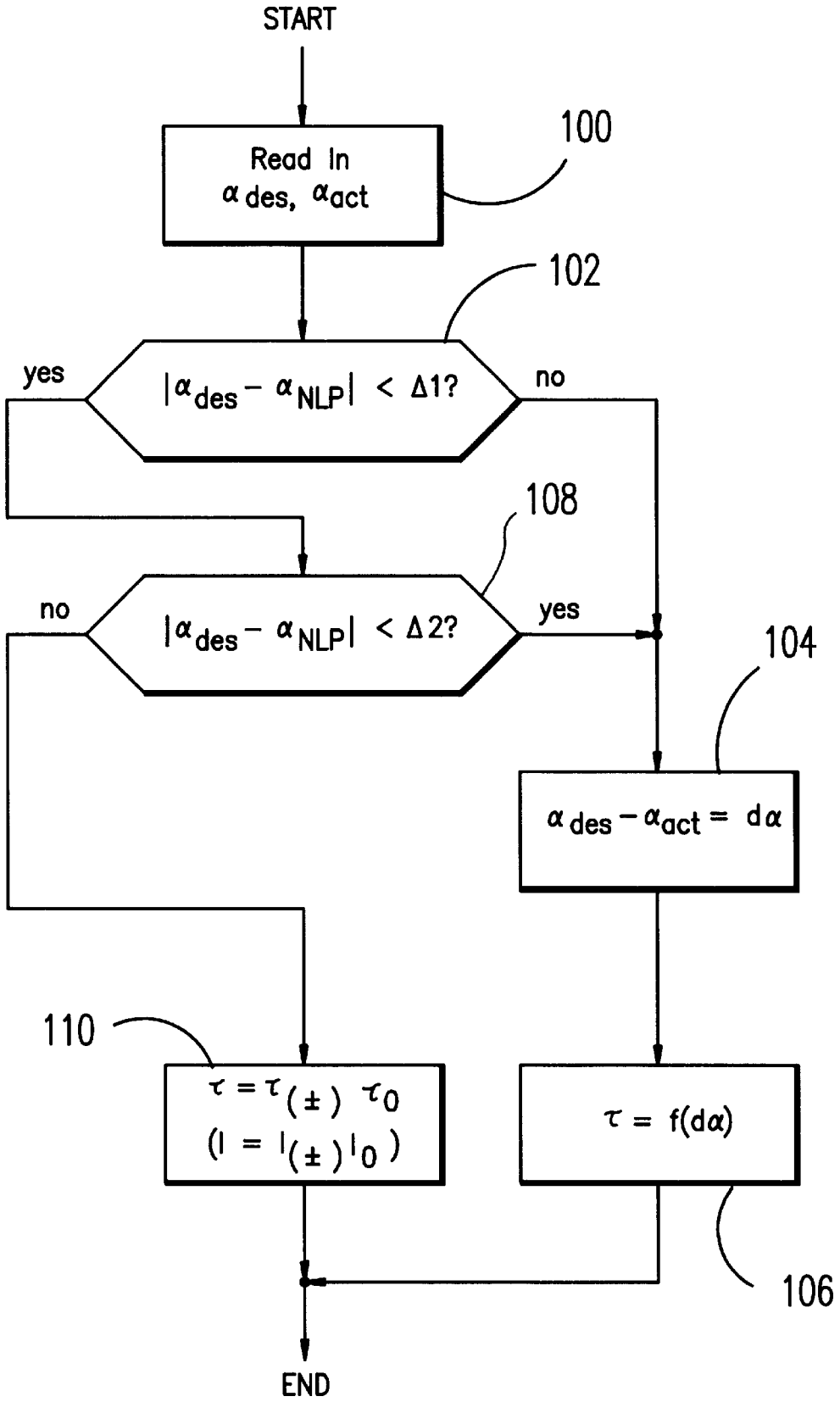
FIGS. 2 and 3 show flowcharts which exemplify embodiments of the method of the invention, which realize the control of the positioning device as well as the detection of the location of the rest position of the positioning device as computer programs.
Figure 3:
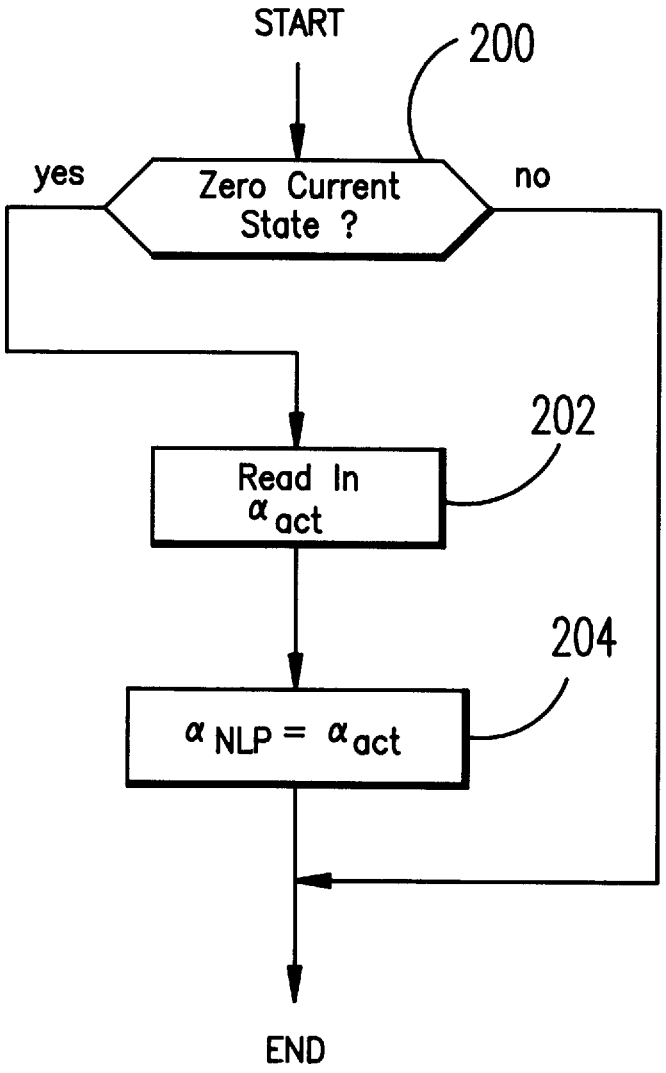

After the start of the subprogram shown in FIG. 2 at pregiven time points (for example, in the interval of several milliseconds), the computed desired set value $\alpha_{des}$ as well as the measured position actual value $\alpha_{act}$ of the positioning device are read in in the first step 100. Thereafter, in step 102, a check is made as to whether the positioning device is in the region of the torque-reversal point. This is realized in the preferred embodiment in that the measured position actual value $\alpha_{act}$ is compared with a tolerance range $\Delta 1$, which is formed about the stored position value for the torque-reversal point $\alpha$NLP. If the position actual value is within the tolerance range, then a "YES" answer is formed; otherwise, a "NO" is formed. If the answer is "NO", then, in step 104, the difference $d\alpha$ is formed from the desired set value and the actual position and, in the next step 106, the drive signal quantity $\tau$ is formed on the basis of the control difference $d\alpha$ in accordance with the controller equation utilized. After step 106, the subprogram is ended and repeated at a pregiven time.

If, in step 102, the result is obtained that the actual position value is located in the region of the torque-reversal point, then, in accordance with step 108, a check is made as to whether this also applies for the set desired value. The regions ($\Delta 1$ and $\Delta 2$), which are compared thereby, are different in the preferred embodiment but can also be equal. If the set desired value is in the range of the torque-reversal point, then the method continues with the step 104 and the control; otherwise, and in accordance with step 110, the drive signal quantity $\tau$ is increased by a pregiven value $\tau 0$. The drive signal quantity $\tau$ was formed in the previous program runthrough based on the control function. After the change, the drive signal quantity is again formed by the controller (step 106).

In another advantageous embodiment, in step 110, the integral component I of the controller is correspondingly changed in lieu of the drive signal quantity which is formed by the integral component I in the steady-state case. After step 110, the subprogram is ended and repeated at a pregiven time.

For a movement of the positioning device beyond the torque-reversal point, the procedure described in FIG. 2 leads to a targeted increase of the drive torque of the positioning device so that the movement of the positioning device beyond the torque-reversal point is essentially linear. The solution provided by the invention therefore defines a precontrol with respect to the controller. The change amount $\tau 0$ or I0 is permanently pregiven in one embodiment. In another advantageous embodiment, this amount is dependent upon an operating variable, for example, on the temperature of the engine or of the positioning device.

The subprogram of FIG. 3 is provided for determining the stored value $\alpha$NLP for the position of the torque-reversal point. This program, too, is initiated at least in predetermined operating states, such as overrun operation or when the engine continues to run after being shut off, at predetermined time points.

In the first step 200, a check is made as to whether a 0 current state is present in the positioning device, that is, whether no current flows through the positioning motor of the positioning device. If this is not the case, the subprogram is ended; otherwise, and in accordance with step 202, the actual value which is measured in this state (after the elapse of a pregiven delay time) is read in and, in accordance with step 204, the stored torque-reversal point αNLP is set to the measured actual value $\alpha_{act}$. The subprogram is then ended after step 204.

Figure 4A:
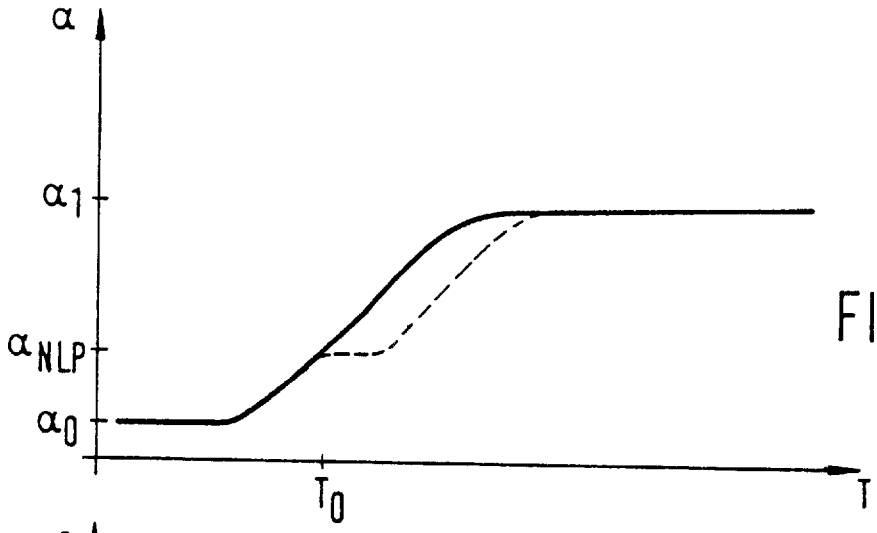
FIG. 4*a* is a graph showing the angular position of the positioning device as a function of time.
Figure 4B:
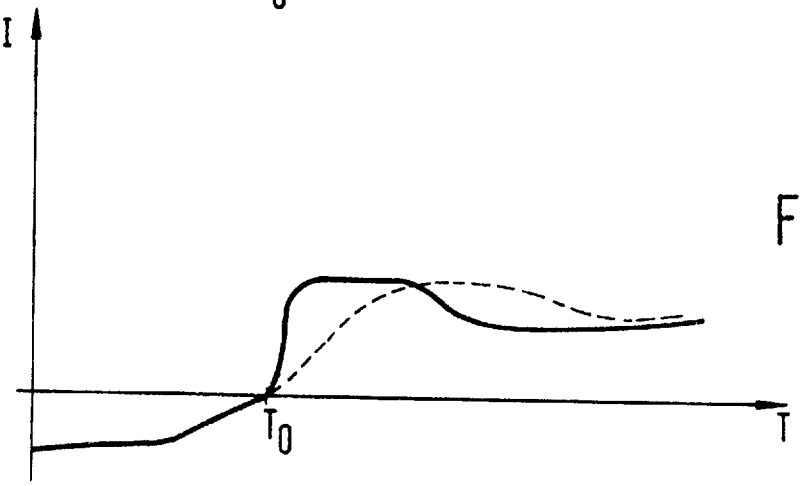
FIG. 4*b* is a graph showing the current in the positioning motor also as a function of time; and, FIG. 5 shows the torque characteristic of the positioning device as a function of position.

The operation of the control of the invention is shown in the time diagrams of FIGS. 4*a* and 4*b*. FIG. 4*a* shows the time-dependent trace of the positioning device position as a function of time; whereas, in FIG. 4*b*, the trace of the current through the positioning motor is plotted as a function of time. The solid line indicates the situation when applying the control according to the invention; whereas, the curve represented by the broken line shows the situation without the application of the control of the invention.

The starting point here is a situation in which the throttle flap is disposed at $\alpha_0$ in the region below the torque-reversal point $\alpha_{NLP}$. By actuating the accelerator pedal, the driver inputs a position value $\alpha_1$ which lies above the torque-reversal point. The negative current (as a consequence of the opening spring torque) is slightly increased by the controller function.

At time point $T_0$, the positioning device is located at the torque-reversal point. This leads to the situation that, in accordance with the control of the invention, a jump-like change of the current takes place as a consequence of the corresponding control of the integral component of the controller or as a consequence of the control of the drive signal quantity. Thereafter, the current is changed in the context of the control and is finally reduced, because of the closing spring torque, to a positive holding current when the desired value is reached.

If the control of the invention would not be used, then no change of the current would occur at $T_0$ which would rather be changed in the context of the lambda control. According to FIG. 4*a*, this would lead to a delay of the setting of the positioning device and would therefore lead to an unsatisfactory control performance.

It is understood that the foregoing description is that of the preferred embodiments of the invention and that various changes and modifications may be made thereto without departing from the spirit and scope of the invention as defined in the appended claims.

What is claimed is:

1. A method for controlling a positioning device of an internal combustion engine, the method comprising the steps of:

providing an electric motor for actuating said positioning device with a torque (M) being applied to said motor over the positioning range (α) and said torque changing sign thereby defining a torque reversal point(αnlp);

detecting the actual position (αact) of said positioning, device;

determining whether said positioning device is in the region of said torque reversal point (αnlp);

forming a drive signal (τ) for the motor on the basis of a desired position (αdes) for said positioning device and said actual position (αact) when said positioning device is not in said region of said torque reversal point (αnlp); and, changing said drive signal (τ) to abruptly change the current through said motor when said positioning device is in said region of said torque reversal point (αnlp).

2. The method of claim 1, wherein the change in said current is so adjusted that the jump in said torque, which occurs at the torque reversal point, is approximately compensated.

3. The method of claim 2, wherein the abrupt change in said current is obtained by an abrupt change of the magnitude of said drive signal (τ).

4. The method of claim 3, wherein said magnitude of said drive signal (τ) is computed by a position controller of a position control; and, a pregiven value is impressed upon said magnitude.

5. The method of claim 4, wherein said value is dependent upon an operating variable.

6. The method of claim 4, wherein said position controller includes at least one integral component which is operated upon to generate the abrupt change of said current.

7. The method of claim 6, wherein a pregiven value is impressed upon said integral component.

8. The method of claim 7, wherein said value is dependent upon an operating variable.

9. The method of claim 4, wherein said abrupt change does not occur when said positioning device is in a pregiven region about said torque reversal point and when a desired set value of said position control is likewise in a pregiven region about said torque reversal point.

10. The method of claim 9, wherein the position assigned to said torque reversal point is detected at zero current through said motor and is stored.

11. An arrangement for controlling a positioning device of an internal combustion engine, the arrangement comprising:

an electric motor for actuating said positioning device with a torque (M) being applied to said motor over the positioning range (α) and said torque changing sign thereby defining a torque reversal point (αnlp);

a position transducer for detecting the actual position (αact) of said positioning device;

means for determining whether said positioning device is in the region of said torque reversal point (αnlp);

a controller for forming a drive signal (τ) for said motor on the basis of a desired position (αdes) for said positioning device and said actual position (αact) when said positioning device is not in said region of said torque reversal point (αnlp); and, means for changing said drive signal (τ) to abruptly change the current through said motor when said positioning device is in said region of said torque reversal point (αnlp).

* * * * *